US006155244A

United States Patent [19]

McClanahan

[11] Patent Number: 6,155,244

[45] Date of Patent: Dec. 5, 2000

[54] ARCHERY BOW SHOT COVER DEVICE

[76] Inventor: Terry Gerard McClanahan, 523 Buena Vista Rd., Chicora, Pa. 16025

[21] Appl. No.: 09/518,979

[22] Filed: Mar. 6, 2000

[51] Int. Cl.[7] ..... F41B 5/14

[52] U.S. Cl. ..... 124/86; 446/404

[58] Field of Search ..... 124/23.1, 86, 88; 446/213, 397, 404

[56] References Cited

U.S. PATENT DOCUMENTS

| | | | |
|---|---|---|---|
| 3,518,959 | 7/1970 | Bunker . | |
| 3,669,059 | 6/1972 | Stuart . | |
| 3,866,592 | 2/1975 | Carella . | |
| 4,572,153 | 2/1986 | MacPherson | 124/88 |
| 4,628,892 | 12/1986 | Windedhal et al. . | |
| 4,862,625 | 9/1989 | Dolan | 446/397 X |
| 5,352,146 | 10/1994 | Shuart | 446/397 |
| 5,419,304 | 5/1995 | Pardue | 124/86 |
| 5,431,590 | 7/1995 | Abas | 446/397 X |
| 5,452,704 | 9/1995 | Wineberger | 124/92 |
| 5,704,154 | 1/1998 | Galfidi | 446/397 X |
| 6,053,793 | 4/2000 | Green | 464/397 X |

*Primary Examiner*—John A. Ricci
*Attorney, Agent, or Firm*—Aileen Champion Addessi

[57] ABSTRACT

The archery bow shot cover device may be attached to various types of bows and is used to produce a natural sound for covering up the noise emanating from the bow when an arrow is released from the bow. The archery bow shot cover device includes a housing which is attached to the bow. The housing contains a pull string which is attached to the string of the bow, a retracting system for retracting the pull string back into the housing when an arrow is shot from the bow, and a sound mechanism for producing a natural sound when the pull string is retracted back into the housing.

20 Claims, 2 Drawing Sheets

ARCHERY BOW SHOT COVER DEVICE

BACKGROUND OF THE INVENTION

The invention relates to archery bows and, more particularly, to a device for covering up the noise emanating from a bow when an arrow is shot therefrom.

When hunting with a bow for deer or other big game species, the animals can hear the vibrating thud or slapping noise made by the bow when the arrow is released from the bow. This noise can scare the animal and cause the animal to move, often resulting in a bad hit, which injures the animal, or miss.

There are several kinds of devices which attempt to reduce this problem. One such device is a bow silencer which reduces the vibration of the string and the slap of the bow components against one another. A silencer is disclosed in U.S. Pat. No. 4,628,892 entitled "Bow and String Silencer". This device is attached to the bow for reducing the noise made by the bow when the string of the bow is released.

Other alternatives to overcome the noise produced during the release of the arrow include using a soft material for an arrow rest, using a lubricating powder on the arrow rest, using a silicone spray to protect and keep surfaces slippery, and using sleeves over the arrow rest surfaces.

However, use of these alternatives does not totally eliminate the noise produced by the bow when the arrow is released, but only reduces the noise. Often, the deer or other animal can still be spooked by the reduced noise.

Therefore, what is needed is an apparatus for covering up the noise produced by the bow when the arrow is released which utilizes a sound mechanism for generating a natural animal sound.

SUMMARY OF THE INVENTION

An archery apparatus for attachment to an archery bow having a string includes a housing attached to the bow and a pull string contained within the housing and retractable into the housing. The pull string has one end secured within the housing and an opposite end removably attached to the string of the bow. The archery apparatus further includes a sound mechanism attached to the housing for producing a natural animal sound, which is activated when the pull string is retracted into the housing for producing the natural animal sound when an arrow is shot from the bow for covering up noise emanating from the bow when the arrow is shot therefrom.

BRIEF DESCRIPTION OF THE DRAWINGS

While the specification concludes with claims particularly pointing out and distinctly claiming the subject matter of the invention, it is believed the invention will be better understood from the following description, taken in conjunction with the accompanying drawings, wherein:

DESCRIPTION OF THE PREFERRED EMBODIMENT

Figure 2:
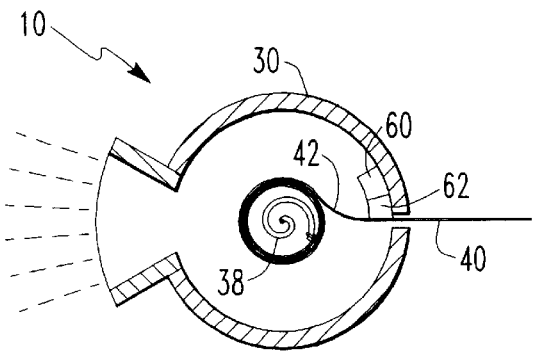
FIG. 2 is a view taken along line 2—2 of FIG. 1.

Referring to FIGS. 1–5, an archery bow shot cover device 10 may be attached to various types of bows, such as a compound bow, a recurve bow, a cross bow, etc. Each type of bow typically includes a handle 22, a limb 24 extending from each end of the handle 22, and a string 26 attached to each outer end of the limbs 24. The archery bow shot cover device 10 may be attached at various positions on different types of bows, such as to a stabilizer positioned on the handle of the bow, to the limb of the bow, or to any other component of the bow. The archery bow shot cover device 10 may be secured to the bow by an attachment member 12, for example, mechanically attached to the bow, such as by a screw, bolt, or the like, adhesively, with a mounting bracket, or by any other suitable means.

Figure 1:
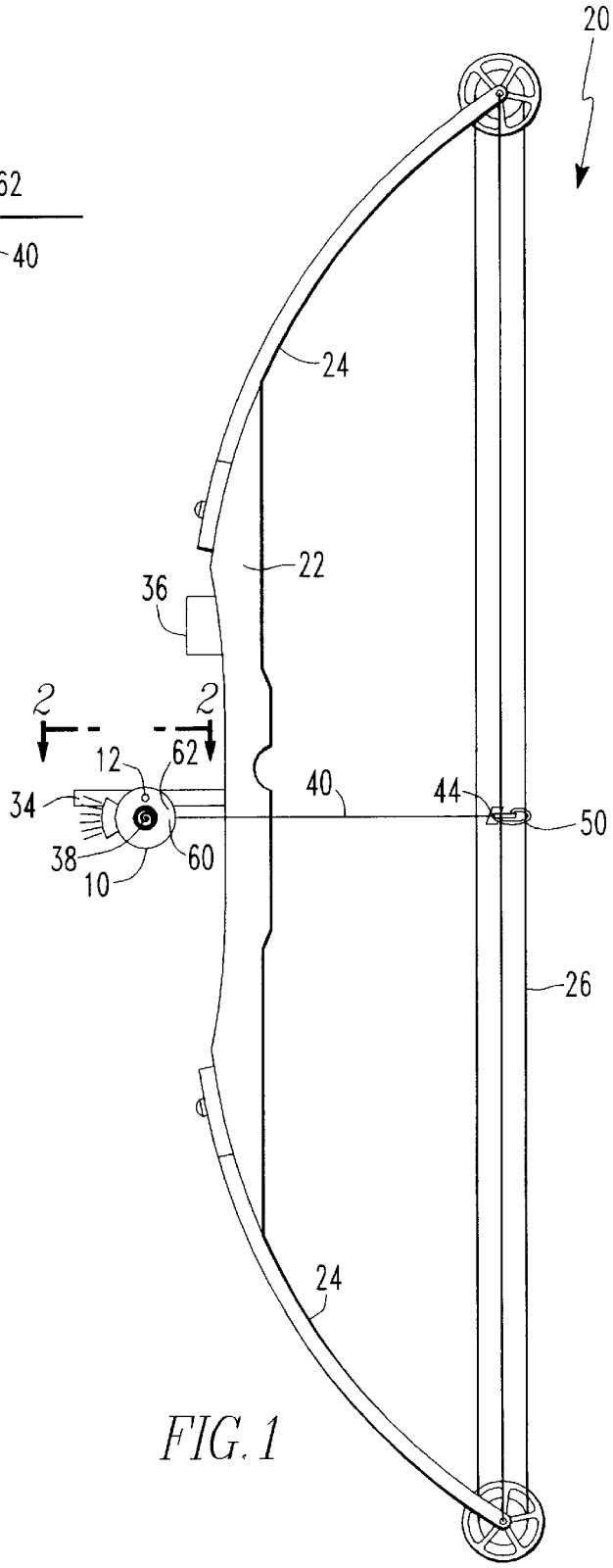
FIG. 1 is a view of an archery bow shot cover device mounted to a string of a compound bow.

Referring to FIGS. 1 and 2, the archery bow shot covering device 10 includes a housing 30 which is attached to a stabilizer 34 on a compound bow 20. Alternatively, the archery bow shot cover device 10 may be attached to a sight bracket 36 of the bow, to a limb 24 of the bow 20, or to any other suitable component or accessory of the bow. The housing 30 may be constructed of plastic or another type of lightweight material.

The housing 30 contains a retracting system 38. As one example, the retracting system 38 may be a spring having a first end and a second end. The first end of the spring is attached to the housing 30. The second or opposite end of the spring is a free end and may extend from the housing 30. When the second end of the spring is pulled, the spring rotates within the housing 30 and unwinds or stretches out. As the spring continues to unwind or stretch out, the tension increases on the spring. Once the spring is released, the tension on the spring causes the spring to automatically wind back up.

A pull string 40 has a first end 42 and a second end 44. The first end 42 is positioned within the housing 20 and is attached to the retracting system 38, such as to the second end of the spring. The pull string 40 may be pulled from the housing 20 and retracted back into the housing 20 by the retracting system 38. The second end 44 of the pull string 40 is attached to the string 26 of the bow 20. Preferably, the second end 44 is removably attached to the string 26 so that the archery bow shot cover device 10 can be removed from the bow 20, such as during practice shooting. The pull string 40 may be attached to the string 26 by a clip 50. The clip 50 should snugly attach to the string 26 so that the pull string 40 does not slide up and down on the string 26. The clip 50 may be a snap hook or any other type of fastening device.

A sound mechanism 60 is attached to the housing 30 and coupled to the pull string 40. When the pull string 40 is retracted back into the housing 30, the sound mechanism 60 is activated and generates a sound, such as a natural animal sound.

The natural animal sound may be a deer grunt, a doe bleat, an elk whistle, a turkey yelp, or the like.

A trigger mechanism 62 may be attached to the housing 30. The trigger mechanism 62 is coupled to the sound mechanism 60 and to the pull string 40 for activating the sound mechanism 60 as the string 40 moves in the retracting direction back into the housing 30 to produce the natural sound.

For the various embodiments of this invention, the same reference characters will be used to designate like parts. In addition, like functions and like interactions of the parts among the various embodiments of this invention will not be repeated for each embodiment.

Figure 3:
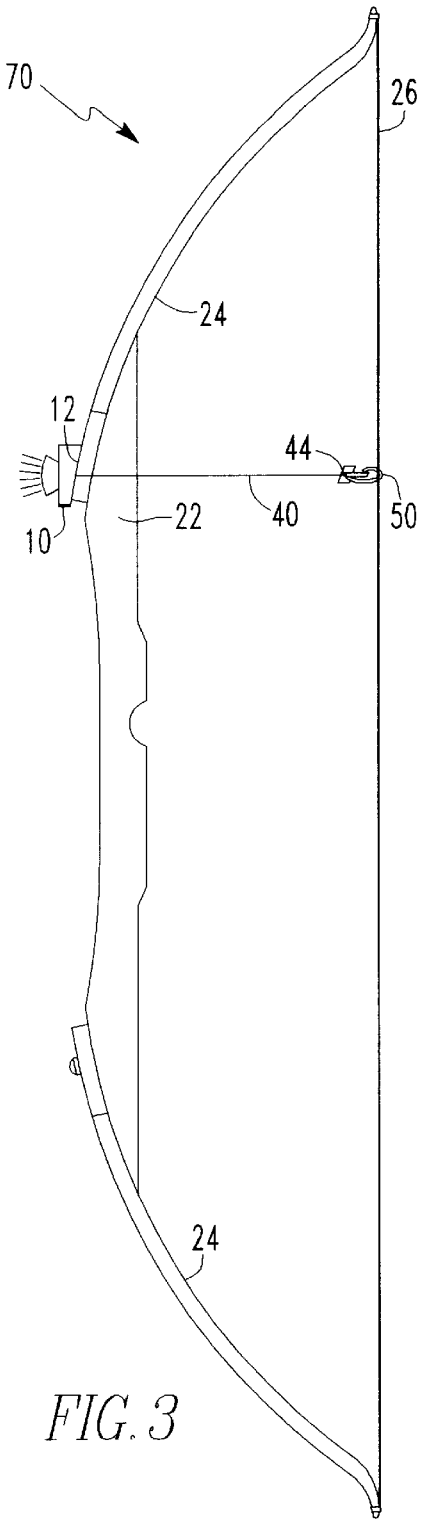
FIG. 3 is a view of the archery bow shot cover device mounted on a recurve bow.

Referring to FIG. 3 and using the same reference characters to define like part, an alternative embodiment comprises the archery bow shot cover device 10 attached to the limb 24 of a recurve bow 70. Alternatively, the archery bow shot cover device 10 may be attached to the handle 22 of the bow 70 or to any other suitable component or accessory of the bow 70.

Figure 4:
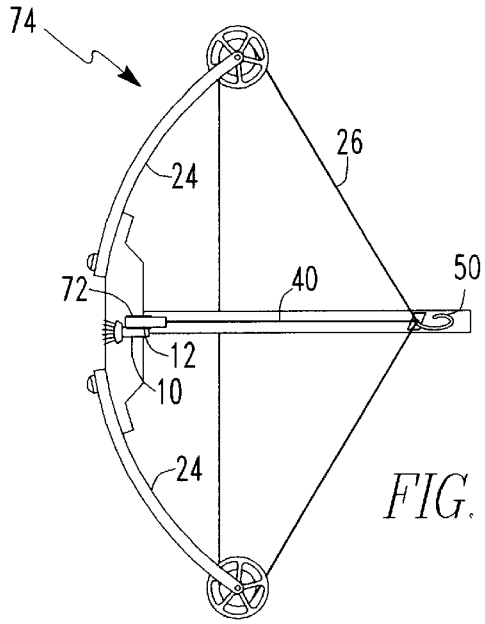
FIG. 4 is a view of the archery bow shot cover device mounted on a cress bow.

Referring to FIG. 4 and using the same reference characters to define like parts, an alternative embodiment comprises the archery bow shot cover device 10 attached to a sight bracket 72 on a cross bow 74. Alternatively, the archery bow shot cover device 10 may be attached to the limb 24 of the bow or to any other suitable component or accessory of the bow 74.

Figure 5:
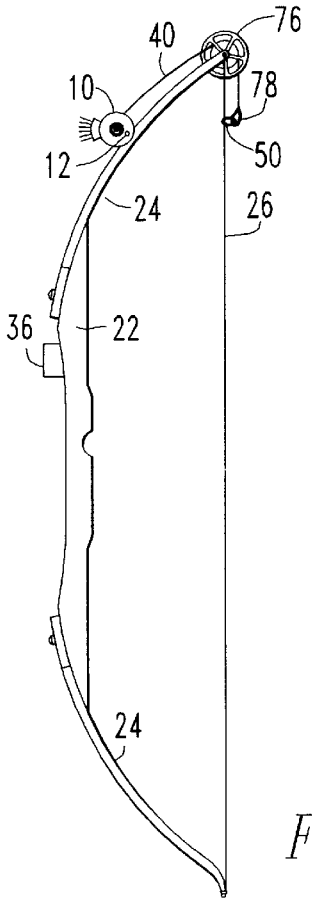
FIG. 5 is a view of the archery bow shot cover device mounted on a limb of a bow in an alternative location.

Referring to FIG. 5 and using the same reference characters to define like parts, an alternative embodiment comprises the archery bow shot cover device 10 attached to an end of the limb 24 of any type of bow. The pull string 40 is positioned in a pulley 76 for guiding the pull string 40 around the end of the limb 24 and is hooked onto the string 26 of the bow. As another alternative, the pull string 40 may be attached to a hook 78, which is secured to the string 26 of the bow, such as to the clip 50.

In operation, a person mounts the archery bow shot cover device 10 to a bow. The pull string 40 is attached to the string 26 of the bow. An arrow is positioned in the bow and during draw of the bow to position the arrow, the pull string 40 is released from the housing 30 and extends from the housing 30 to the extended string 26 of the bow. During this set-up, the sound mechanism 60 remains quiet.

When it is decided to release the arrow, such as to shoot an animal, the arrow is released in the normal manner. After release of the arrow, the string 26 of the bow moves back to its original position allowing the pull string 40 to be retracted back into the housing 30. The retraction of the pull string 40 activates the trigger mechanism 62 to sound the sound mechanism 60. As the arrow travels toward the animal, a natural sound is produced by the archery bow shot cover device 10 for covering up the noise produced by the bow during release of the arrow.

Advantages of the archery bow shot cover device 10 are that the animal is less likely to be startled by the natural sound produced by the archery bow shot cover device 10, than by the vibrating thud or slapping noise produced by the bow during release of the arrow. If the animal is not startled, it is more likely to remain in the position that it was in when the arrow was shot, increasing tie percentage of a good hit which kills the animal and not just injures the animal.

Another advantage is that the pull string 40 may be removed from the string 26, such as by unsnapping the clip 50 from the string 26, during practice or for storage.

Thus there has been shown and described a novel archery bow shot cover device which fulfills all the objects and advantages sought therefor. Many changes, modifications, variations and other uses and applications of the subject invention will, however, become apparent to those skilled in the art alter considering this specification together with the accompanying drawings and claims. All such changes, modifications, variations and other uses and applications which do not depart from the spirit and scope of the invention are deemed to be covered by the invention which is limited only by the claims which follow.

I claim:

1. An archery apparatus for attachment to an archery bow having a string, comprising:

a housing attached to the bow;

a pull string contained within said housing and retractable into said housing, said pull string having one end secured within said housing and an opposite end extendable from said housing and removably attached to the string of the bow; and a sound mechanism attached to said housing for producing a natural animal sound, said sound mechanism activated when said pull string is retracted into said housing for producing said natural animal sound when an arrow is shot from the bow for covering up noise emanating from the bow when the arrow is shot therefrom.

2. The archery apparatus according to claim 1, wherein said sound mechanism produces a grunt.

3. The archery apparatus according to claim 1, wherein said sound mechanism produces a bleat.

4. The archery apparatus according to claim 1, further comprising a clip attached to said pull string and engagable with the string of the bow.

5. The archery apparatus according to claim 1, the bow having the string attached to opposite ends of a limb of the bow, wherein said housing is attached to the limb of the bow.

6. The archery apparatus according to claim 5, the bow having a pulley attached to the limb of the bow, wherein said pull string is positioned within said pulley for guiding said pull string around the limb of the bow.

7. The archery apparatus according to claim 1, the bow having a stabilizer, wherein said housing is attached to the stabilizer of the bow.

8. The archery apparatus according to claim 1, further comprising a trigger mechanism coupled to said sound mechanism and to said pull string, said trigger mechanism activates said sound mechanism when said pull string is retracted into said housing for producing said natural animal sound.

9. The archery apparatus according to claim 8, wherein said sound mechanism and said trigger mechanism are contained within said housing.

10. The archery apparatus according to claim 1, further comprising a hook attached to the string of the bow for engagement with said pull string for securing said pull string to the string of the bow.

11. The archery apparatus according to claim 1, further comprising a retracting system attached to said pull string for retracting said pull string back into said housing.

12. An archery bow shot cover device for attachment to an archery bow having a string, comprising:

a housing attached to the bow;

a pull string contained within said housing and having one end secured within said housing and an opposite end removably attached to the string of the bow;

a retracting system attached to said housing and attached to said pull string for retracting said pull string back into said housing when the string of the archery bow is released; and a sound mechanism attached to said housing and coupled to said pull string for producing a natural animal sound when said pull string is retracted back into said housing for covering up noise emanating from the bow when an arrow is released from the bow.

13. The archery bow shot cover device according to claim 12, further comprising a clip attached to said pull string and engagable with the string of the bow.

14. The archery bow shot cover device according to claim 12, further comprising an attachment member connected to said housing and to the bow for securing said housing to the bow.

15. The archery bow shot cover device according to claim 12, wherein said sound mechanism produces a grunt.

16. The archery bow shot cover device according to claim 12, wherein said sound mechanism produces a bleat.

17. An archery apparatus for attachment to a bow, said bow having a handle, a limb attached to each end of the handle and extending in opposite directions therefrom, and a string connected to each outer end of the limbs, comprising:

a housing attached to the bow;

an attachment member connected to said housing and to the bow for securing said housing to the bow;

a pull string contained within said housing and having a first end and a second end, one of said first and second ends secured within said housing;

a clip attached to the other of said first and second ends of the pull string, said clip removably attachable to the string of the bow;

a retracting system attached to said pull string for retracting said pull string back into said housing when the string of the bow is released;

a sound mechanism attached to said housing for producing a natural animal sound; and a trigger mechanism contained within said housing and coupled to said sound mechanism and to said pull string, said trigger mechanism activates said sound mechanism when said pull string is retracted into said housing for producing said natural animal sound for covering up noise emanating from the bow when an arrow is shot from the bow.

18. The archery apparatus according to claim 17, wherein said sound mechanism produces a grunt.

19. The archery apparatus according to claim 17, wherein said sound mechanism produces a bleat.

20. The archery apparatus according to claim 17, further comprising a hook attached to the string of the bow for engagement with said pull string for securing said pull string to the string of the bow.

* * * * *